US007571815B2

(12) United States Patent
Pufal et al.

(10) Patent No.: US 7,571,815 B2
(45) Date of Patent: Aug. 11, 2009

(54) SIEVE JIGGER

(75) Inventors: Hans Rolf Pufal, Köln (DE); Jürgen Juranek, Essen (DE); Hans-Günther Kreutzer, Duisburg (DE)

(73) Assignee: KHD Humboldt Wedag GmbH, Cologne (DE)

( * ) Notice: Subject to any disclaimer, the term of this patent is extended or adjusted under 35 U.S.C. 154(b) by 442 days.

(21) Appl. No.: 10/536,521

(22) PCT Filed: Nov. 19, 2003

(86) PCT No.: PCT/EP03/12933

§ 371 (c)(1),
(2), (4) Date: Nov. 28, 2005

(87) PCT Pub. No.: WO2004/047996

PCT Pub. Date: Jun. 10, 2004

(65) Prior Publication Data

US 2006/0163123 A1 Jul. 27, 2006

(30) Foreign Application Priority Data

Nov. 27, 2002 (DE) ..... 102 55 321

(51) Int. Cl.
*B03B 7/00* (2006.01)

(52) U.S. Cl. ..... 209/13; 209/18; 209/364; 209/365.1; 209/365.3

(58) Field of Classification Search ..... 209/13, 209/18, 364, 365.1, 365.3, 379, 380, 503, 209/504, 436, 437
See application file for complete search history.

(56) References Cited

U.S. PATENT DOCUMENTS 4,563,271 A * 1/1986 Schroder et al. ..... 209/427

(Continued)

FOREIGN PATENT DOCUMENTS

DE 3322137 A1 12/1984
DE 3428824 A1 2/1996

OTHER PUBLICATIONS

Aufbereitungs-Technik Publication dated Dec. 30, 1989., No. 12 entitled Operational experience on a moving-bed jig built by KHD Humboldt Wedag AG for predestoning at the Emil Mayrisch colliery.

*Primary Examiner*—Patrick H Mackey
*Assistant Examiner*—Terrell H Matthews
(74) *Attorney, Agent, or Firm*—Greer, Burns & Crain, Ltd.

(57) ABSTRACT

The aim of the invention is to provide a sieve jigger comprising a sieved-product rocker that can be pivoted upwards and downwards, whose lifting displacement and/or lifting frequency can be controlled beyond previously accepted limits and which does not require vibration dampers that are subject to wear. To achieve this, the sieved-product rocker is operated by means of a lifting and braking cylinder comprising an integrated measuring device for the displacement of the cylinder piston and a working chamber, to which a hydraulic-oil supply and evacuation conduit is connected, said conduit containing an integrated proportional control valve. The lifting and braking cylinder interacts with the proportional control valve by means of a displacement sensor and a governor in order to control the displacement upwards and downwards and thus the lifting height and/or the lifting frequency of the rocker.

16 Claims, 2 Drawing Sheets

U.S. PATENT DOCUMENTS 5,207,742 A * 5/1993 Scutt et al. ..... 209/455
5,740,920 A * 4/1998 Timmermann ..... 209/455
6,070,738 A * 6/2000 Lyman et al. ..... 209/457
2006/0070593 A1* 4/2006 Schmidt ..... 123/90.59

* cited by examiner

SIEVE JIGGER

BACKGROUND OF THE INVENTION

The invention relates to a sieve jigger for sorting solid material mixtures, such as raw coal or other minerals, in a separating liquid, such as water, according to density, in particular for the pre-separation of tailings, comprising a rocker that can pivot in the water bath and carries the sieved-product carrier and the sieved-product, which rocker executes an upward stroke by way of a pivotedly connected hydraulic cylinder and a downward stroke by letting it fall under the force of gravity.

From the leaflet 4-230d of KHD Humboldt Wedag AG of June 1989 the so-called ROMJIG sieve jigger is known for the pre-separation of tailings from raw coal. The jigging takes place in a water bath. The loosening of the material required for the sorting according to density is produced by the lifting or pivoting upward and dropping down of a rocker which is pivotally mounted in the water bath and carries the sieved-product carrier and the product. The lower specific density coal and the higher specific density tailings are separately discharged from the jigging machine by a lifting wheel.

With the known sieve jigger, the upward pivoting movement, i.e., the upward stroke of the sieved-product rocker, takes place by hydraulic oil flowing into a single-acting hydraulic cylinder which engages the rocker. On reaching a lifting height of, for example, 300 to 400 mm, the rocker is allowed to drop and moves downwards again as a result of gravity and its own mass (including the sieved-product) of, for example, 4000 to 5000 kg. In doing so the loaded rocker at the end of its downward movement falls onto at least two hydraulic vibration dampers, which are able to transmit the forces released during the falling down of the rocker in an as jolt-free manner as possible. It was found that with this type of rocker drive the lifting frequency of the rocker is limited to approximately 40 strokes per minute. In addition, the vibration dampers are subject to wear and an undesirable heat generation.

SUMMARY OF THE INVENTION

The aim of the invention is to provide a sieve jigger comprising a sieved-product rocker that can be pivoted upwards and downwards, the lifting displacement and/or lifting frequency of which can be controlled beyond previously accepted limits and which does not require vibration dampers that are subject to wear.

With the sieve jigger according to the invention, the drive of the sieved-product rocker takes place neither with a usual single-acting hydraulic cylinder nor with a usual so-called double-acting cylinder. On the contrary, the drive of the sieve jigger according to the invention is designed as a lifting and braking cylinder which uses one single cylinder working chamber to perform various tasks. Connected to this cylinder working chamber is a hydraulic oil supply and evacuation conduit with an integrated proportional control valve. The lifting and braking cylinder is furthermore equipped with a measuring device for the displacement of the cylinder piston, the measuring signal of which is fed by way of a displacement sensor to a governor, which is operatively connected to the proportional control valve in order to control the upward movement and the downward movement and thus the lifting height and/or lifting frequency of the rocker.

The control intervention on the proportional regulating valve takes place here in such a way that for the pivoting upwards of the rocker, hydraulic oil is fed through the hydraulic oil supply and evacuation conduit into the working chamber of the lifting and braking cylinder until before the upper dead point of the piston is reached, and for lowering the rocker, it first falls in free fall while displacing hydraulic oil from the cylinder working chamber and discharging hydraulic oil through the same conduit, followed by hydraulic braking of the cylinder piston before the lower dead point is reached. The hydraulic drive cylinder accordingly at the same time takes on the function of a controlled vibration damping, i.e., the rocker does not require its own mechanical vibration dampers for limiting the lifting displacement of the rocker.

The working cycle of the lifting and braking cylinder consists, therefore, of the lifting phase of the rocker, the free-fall phase of the rocker and the braking phase of the rocker, wherein all three phases can be controlled independently. The sieved-product rocker can, therefore, be controlled within respect to its lifting displacement and/or its lifting frequency beyond previously accepted limits, and the operation of the sieve jigger can be optimized further with regard to the throughput and/or its separation effect depending upon the respective sorting process, the respective mineral mixtures that have to be sorted, etc.

The invention and its further characteristics and advantages will be explained in more detail in the following with reference to the exemplified embodiment illustrated diagrammatically in the figures.

BRIEF DESCRIPTION OF THE DRAWING

The invention and its further features and advantages are described in greater detail with the aid of the embodiments schematically represented in the drawing.

DETAILED DESCRIPTION OF THE PREFERRED EMBODIMENT

Figure 1:
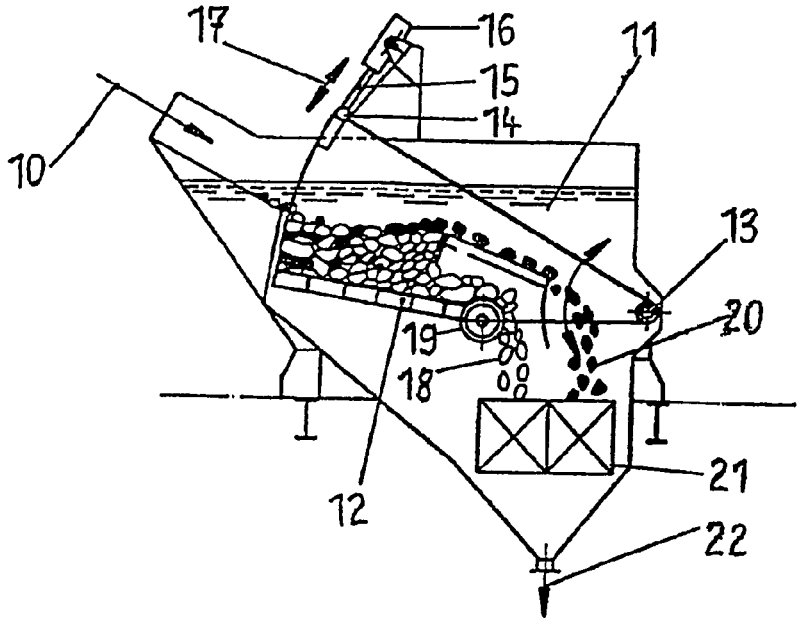
FIG. 1. illustrates diagrammatically in vertical section a sieve jigger for the density sorting of raw coal in operation.

With the sieve jigger of FIG. 1 the density sorting of the charged raw coal 10 takes place in a water bath 11. The loosening of the material required for the sorting is produced by the pivoting upwards and downwards of a sieved-product rocker 12 with a pivoting axis 13 located in the water bath 11. Linked to a crossbar of the rocker 12 at a linkage point 14 is the piston rod 15 of a hydraulic cylinder 16, which according to the invention is designed as a lifting and braking cylinder. The lifting height of the rocker, representing part of a circular arc, is indicated by the double arrow 17. At a mass of the rocker 12 including the material of approximately 4000 to 5000 kg, the lifting height 17 of the rocker amounts, for example, to approximately 300 to 400 mm at a lifting frequency of, for example, 40 strokes per minute.

The transport of the to be sorted material 10 through the sieve jigger takes place by the movements of the rocker 12 as well as by the slope pressure of the material. Whereas the tailings 18 with the higher specific density are drawn off via a discharge roller 19, the coal with the lighter specific density as well as the middlings 20 are drawn off through a separate chute. Both products, i.e., tailings 18 and coal/middlings 20 are discharged from the jigger separately from one another by a twin lifting wheel 21 and in doing so are de-watered, while the fines 22 that have fallen through the sieved-product carrier into the drum are discharged from the jigger at the bottom and fed to a fines sorting process.

Figure 2:
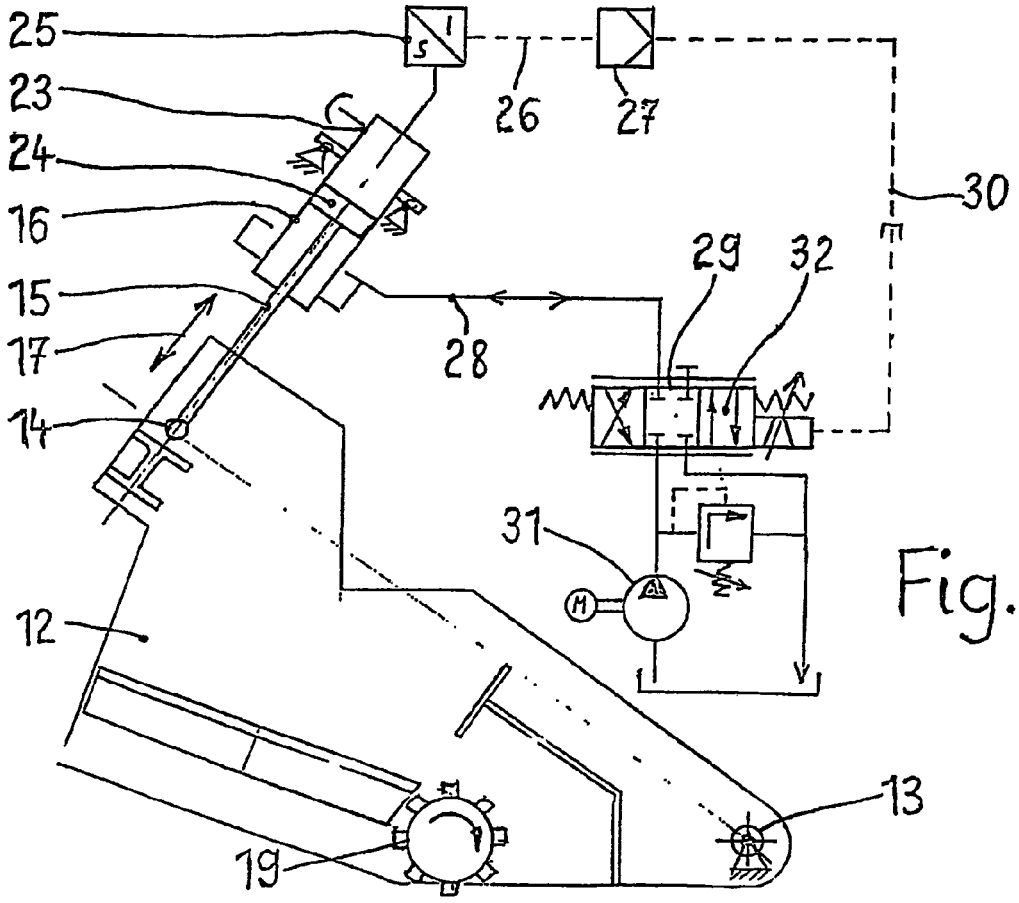
FIG. 2. shows schematically, in greater detail, the drive of the sieved-product rocker using a hydraulic lifting and braking cylinder, and FIG. 3. shows the upward and downward movement of the sieved-product rocker of FIG. 2 seen at the connection point of the lifting and braking cylinder, in a diagram in which the lifting height (h) is plotted against time (t).

Integrated into the pivotedly mounted lifting and braking cylinder 16, shown on a larger scale in FIG. 2, is a displacement measuring device 23 for the piston 24, wherein the measuring signal is passed via a signal line to a displacement sensor 25, which in turn via a signal line 26 is connected to a governor 27. Connected to the working chamber of the cylinder 16 is a hydraulic oil supply and evacuation conduit 28, in which a proportional control valve 29 is integrated. The lifting and braking cylinder 16 is operatively connected via the governor 27 via a further signal line 30 to the proportional control valve 29 in order to control the upward movement and the downward movement and accordingly the lifting height 17 and/or the lifting frequency of the sieved-product rocker 12.

Figure 3:
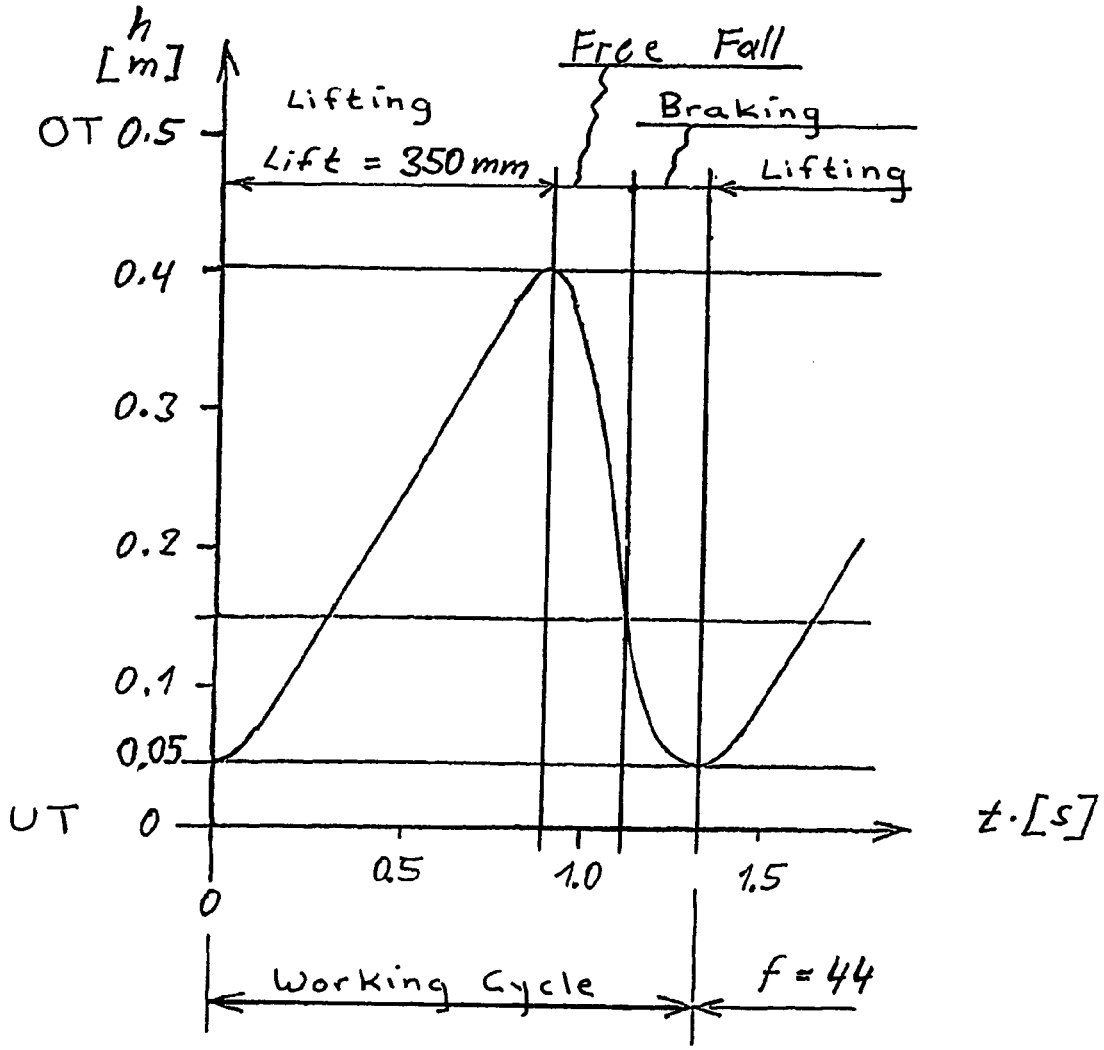

As can clearly be noted from the operating diagram of FIG. 3, the operating cycle of the lifting and braking cylinder 16 consists of three phases, i.e. the lifting phase of the rocker 12, the free-fall phase of the rocker and a braking phase of the rocker, wherein all three phases can be controlled independently. The difference between the upper and lower piston position of the lifting and braking cylinder 16 corresponds to the lifting displacement 17 of the rocker 12 of, for example, 350 mm, wherein the lifting displacement range lies between the limits of the upper dead point OT and the lower dead point UT of the cylinder piston 24.

The proportional control valve 29 is arranged in the hydraulic oil circuit between the motor-driven hydraulic oil pump 31 of the hydraulic unit and the working chamber of the lifting and braking cylinder 16.

The control intervention on the proportional control valve 29 takes place in such a way that for the lifting, i.e., the upward movement of the rocker 12, hydraulic oil is fed through the hydraulic oil supply and evacuation conduit 28 into the working chamber of the lifting and braking cylinder 16 until before the upper dead point OT is reached. In order to lower the rocker 12, it first falls in free-fall during which hydraulic oil is displaced from the working chamber of the cylinder and hydraulic oil is discharged through the same conduit 28, followed by a hydraulic braking of the cylinder piston 24 before the lower dead point UT is reached.

According to the diagram of FIG. 3, the time for a working cycle of the lifting and braking cylinder 16 at a rocker lifting displacement of 350 mm is 1.36 seconds, which corresponds to a lifting frequency of f=44 cycles per minute. An electronic timing generator system 32 included in the proportional control valve 29 ensures an accurately timed supply of hydraulic oil to the hydraulic oil conduit 28 for the purpose of maintaining the three successive periodic time intervals for the lifting phase, free-fall phase and braking phase of the rocker 12, wherein these three phases in each instance result in a working cycle of the lifting and braking cylinder 16.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A sieve jigger for sorting solid material mixtures in a separating liquid bath according to density, comprising:

a rocker mounted to pivot about a pivoting axis in the liquid bath and to carry the solid material mixtures;

a hydraulic cylinder with a single working pressure chamber pivotally connected to the rocker to lift the rocker upwardly and to brake a downward movement of the rocker;

a displacement measuring device operatively connected to a piston of the hydraulic cylinder and to generate a measuring signal;

a displacement sensor arranged to receive the measuring signal from the displacement measuring device and to generate a displacement signal;

a governor arranged to receive the displacement signal from the displacement sensor and to generate a control signal;

a motor driven hydraulic oil pump;

a hydraulic oil supply and evacuation conduit connected to the single working pressure chamber of the hydraulic cylinder;

a proportional control valve communicating with the hydraulic oil supply and evacuation conduit and arranged to receive the control signal from the governor, the proportional control valve being configured to have a first lifting position in which the motor driven hydraulic oil pump is connected to the single working pressure chamber via the proportional control valve, a second free-fall position in which the single working pressure chamber is unrestrictedly connected to a hydraulic oil sump, and a third deceleration position in which the single working pressure chamber is closed off from the hydraulic oil pump and reservoir;

the displacement measuring device being operatively connected via the governor to the proportional control valve in order to control the upward movement and the downward movement of the rocker, in a first lifting phase, a second free-fall phase and a third deceleration phrase, including controlling at least one of a lifting displacement and a lifting frequency.

2. A sieve jigger according to claim 1, wherein, to lift the rocker in the first lifting phase, the proportional control valve is arranged in the first lifting position such that hydraulic oil is fed through the hydraulic oil supply and evacuation conduit and the proportional control valve into the single working pressure chamber of the lifting and braking cylinder until before an upper dead point of the hydraulic cylinder is reached and, to lower the rocker, hydraulic oil is displaced from the working chamber of the hydraulic cylinder and is discharged through the hydraulic oil supply and evacuation conduit and proportional control valve in the free-fall position during the free-fall phase followed by a hydraulic braking of the cylinder piston during the deceleration phase with the control valve in the free-fall position or the deceleration position in accordance with the control signal from the governor before a lower dead point of the hydraulic cylinder is reached.

3. A sieve jigger according to claim 1, wherein the lifting and braking cylinder and the proportional control valve are arranged such that all three phases of lifting, free-fall and deceleration can be controlled independently.

4. A sieve jigger according to claim 1, wherein a difference between an upper and lower piston position of the lifting and braking cylinder corresponds to a lifting displacement of the rocker, wherein a lifting displacement range lies between an upper dead point limit and a lower dead point limit of the cylinder piston.

5. A sieve jigger according to claim 1, wherein the governor is connected via a signal line to the displacement measuring device of the lifting and braking cylinder and is connected via a further signal line to the proportional control valve, which is arranged in the hydraulic oil circuit between a hydraulic oil pump and the single working pressure chamber of the lifting and braking cylinder.

6. A sieve jigger according to claim 1, wherein the proportional control valve includes a controllable electronic timing generator system.

7. A sieve jigger for sorting solid material mixtures in a separating liquid bath according to density, comprising:

a rocker mounted to pivot about a horizontal pivoting axis located in the separating liquid bath, the rocker arranged to carry the solid material mixtures in the liquid bath;

a hydraulic cylinder having a piston and a single working pressure chamber, the piston of the hydraulic cylinder being connected to the rocker at a linkage point spaced from the pivoting axis to lift the rocker upwardly and to brake a downward movement of the rocker;

a displacement measuring device operatively connected to the piston and configured to generate a measuring signal;

a displacement sensor arranged to receive the measuring signal from the displacement measuring device and to generate displacement signal;

a governor arranged to receive the displacement signal from the displacement sensor and to generate a control signal;

a motor driven hydraulic oil pump;

a hydraulic oil supply and evacuation conduit connected to the single working pressure chamber;

a proportional control valve located in the hydraulic oil supply and evacuation conduit and arranged to receive the control signal from the governor, the proportional control valve being configured to have a first lifting position in which the motor driven hydraulic oil pump is connected to the single working pressure chamber via the proportional control valve, a second free-fall position in which the single working pressure chamber is unrestrictedly connected to a hydraulic oil sump, and a third deceleration position in which the single working pressure chamber is closed off from the hydraulic oil pump and reservoir; and wherein, in a first lifting phase hydraulic oil is provided through the proportional control valve while it is in the first lifting position and the hydraulic oil supply and evacuation conduit to the single working pressure chamber to pivotally lift the rocker, in a second free-fall phase hydraulic coil is permitted to flow out of the single working pressure chamber through the hydraulic oil supply and evacuation conduit and proportional control valve in the second free-fall position essentially unrestricted, and in a third deceleration phase hydraulic oil is permitted to flow out of the single working pressure cylinder through the hydraulic oil supply and evacuation conduit and the proportional control valve in the deceleration position or free-fall position in accordance with the control signal from the governor.

8. A sieve jigger according to claim 7, wherein, to lift the rocker, the proportional control valve is arranged such that hydraulic oil is fed through the hydraulic oil supply and evacuation conduit and the proportional control valve into the single working pressure chamber of the lifting and braking cylinder until before an upper dead point of the hydraulic cylinder is reached and, to lower the rocker, hydraulic oil is displaced from the working chamber of the hydraulic cylinder and is discharged through the hydraulic oil supply and evacuation conduit and proportional control valve in a free-fall mode followed by a hydraulic braking of the cylinder piston before a lower dead point of the hydraulic cylinder is reached.

9. A sieve jigger according to claim 7, wherein the lifting and braking cylinder and the proportional control valve are arranged to have a working cycle comprising a lifting phase of the rocker, a free-fall phase of the rocker and a braking phase of the rocker, wherein all three phases can be controlled independently.

10. A sieve jigger according to claim 7, wherein a difference between an upper and lower piston position of the lifting and braking cylinder corresponds to a lifting displacement of the rocker, wherein a lifting displacement range lies between an upper dead point limit and a lower dead point limit of the cylinder piston.

11. A sieve jigger according to claim 7, wherein the proportional control valve includes a controllable electronic timing generator system.

12. A sieve jigger for sorting solid material mixtures in a separating liquid bath according to density, comprising:

a rocker mounted to pivot about a pivoting axis, the rocker arranged to carry the solid material mixtures in the liquid bath;

a hydraulic cylinder having a piston and a single working pressure chamber;

the piston of the hydraulic cylinder being connected to the rocker at a linkage point spaced from the pivoting axis to lift the rocker upwardly and to brake a downward movement of the rocker;

a displacement measuring device operatively connected to the piston and configured to generate a measuring signal;

a displacement sensor arranged to receive the measuring signal from the displacement measuring device and to generate a displacement signal;

a governor arranged to receive the displacement signal from the displacement sensor and to generate a control signal;

a motor driven hydraulic oil pump;

a hydraulic oil supply and evacuation conduit connected to the single working pressure chamber;

a proportional control valve communicating with the hydraulic oil supply and evacuation conduit and arranged to receive the control signal from the governor, the proportional control valve being configured to have a first lifting position in which the motor driven hydraulic oil pump is connected to the single working pressure chamber via the proportional control valve, a second free-fall position in which the single working pressure chamber is unrestrictedly connected to a hydraulic oil sump, and a third deceleration position in which the single working pressure chamber is closed off from the hydraulic oil pump and reservoir; and wherein, in a first lifting phase hydraulic oil is provided through the proportional control valve while it is in the first lifting position and the hydraulic oil supply and evacuation conduit to the single working pressure chamber to pivotally lift the rocker, in a second free-fall phase hydraulic coil is permitted to flow out of the single working pressure chamber through the hydraulic oil supply and evacuation conduit and proportional control valve in the second free-fall position essentially unrestricted, and in a third deceleration phase hydraulic oil is permitted to flow out of the single working pressure cylinder through the hydraulic oil supply and evacuation conduit and the proportional control valve in the deceleration position or free-fall position in accordance with the control signal from the governor.

13. A sieve jigger according to claim 12, wherein, to lift the rocker, the proportional control valve is arranged such that hydraulic oil is fed through the hydraulic oil supply and evacuation conduit and the proportional control valve into the single working pressure chamber of the lifting and braking cylinder until before an upper dead point of the hydraulic cylinder is reached and, to lower the rocker, hydraulic oil is displaced from the working chamber of the hydraulic cylinder and is discharged through the hydraulic oil supply and evacuation conduit and proportional control valve in a free-fall mode followed by a hydraulic braking of the cylinder piston before a lower dead point of the hydraulic cylinder is reached.

14. A sieve jigger according to claim 12, wherein the lifting and braking cylinder and the proportional control valve are arranged to have a working cycle comprising a lifting phase of the rocker, a free-fall phase of the rocker and a braking phase of the rocker, wherein all three phases can be controlled independently.

15. A sieve jigger according to claim 12, wherein a difference between an upper and lower piston position of the lifting and braking cylinder corresponds to a lifting displacement of the rocker, wherein a lifting displacement range lies between an upper dead point limit and a lower dead point limit of the cylinder piston.

16. A sieve jigger according to claim 12, wherein the proportional control valve includes a controllable electronic timing generator system.

* * * * *